US009590315B2

(12) United States Patent
Evtyushkin et al.

(10) Patent No.: US 9,590,315 B2
(45) Date of Patent: Mar. 7, 2017

(54) PLANAR LINEAR PHASE ARRAY ANTENNA WITH ENHANCED BEAM SCANNING

(71) Applicant: Samsung Electronics Co., Ltd., Suwon-si, Gyeonggi-do (KR)

(72) Inventors: Gennadiy Alexandrovich Evtyushkin, Moscow (RU); Timofey Viktorovich Kamyshev, Moscow (RU); Elena Alexandrovna Shepeleva, Kostroma (RU)

(73) Assignee: Samsung Electronics Co., Ltd., Suwon-si (KR)

( * ) Notice: Subject to any disclaimer, the term of this patent is extended or adjusted under 35 U.S.C. 154(b) by 48 days.

(21) Appl. No.: 14/800,034

(22) Filed: Jul. 15, 2015

(65) Prior Publication Data

US 2016/0020526 A1 Jan. 21, 2016

(30) Foreign Application Priority Data

Jul. 15, 2014 (RU) ..... 2014129187
Jun. 25, 2015 (KR) ..... 10-2015-0090368

(51) Int. Cl.

| | |
|---|---|
| ***H01Q 3/26*** | (2006.01) |
| ***H01Q 15/24*** | (2006.01) |
| ***H01Q 13/08*** | (2006.01) |
| ***H01Q 15/23*** | (2006.01) |
| ***H01Q 21/08*** | (2006.01) |

(52) U.S. Cl.

CPC ..... *H01Q 15/246* (2013.01); *H01Q 13/08* (2013.01); *H01Q 15/23* (2013.01); *H01Q 21/08* (2013.01)

(58) Field of Classification Search

CPC ..... H01Q 13/08; H01Q 15/23; H01Q 15/246; H01Q 21/08; H01Q 13/085; H01Q 25/00; H01Q 3/2658; H01Q 3/267

USPC ..... 343/700 MS, 754, 755, 756, 757, 771, 343/772, 817, 833, 834, 853

See application file for complete search history.

(56) References Cited

U.S. PATENT DOCUMENTS 3,771,158 A * 11/1973 Hatcher ..... H01Q 5/42 343/728
4,150,382 A * 4/1979 King ..... H01Q 3/44 342/376
4,905,014 A * 2/1990 Gonzalez ..... H01Q 3/46 343/700 MS (Continued)

OTHER PUBLICATIONS

Lee et al., "Beamforming Lens Antenna on a High Resistivity Silicon Wafer for 60 GHz WPAN", IEEE Transactions on Antennas and Propagation, Mar. 2010, pp. 706-713, vol. 58, No. 3.

*Primary Examiner* — Tho G Phan
(74) *Attorney, Agent, or Firm* — Jefferson IP Law, LLP

(57) ABSTRACT

An apparatus for a planar phase array antenna is provided. The planar phase array antenna includes a planar waveguide formed by a top ground and a bottom ground with a dielectric layer between the top ground and the bottom ground, a phase array, including radiators, configured to form an electromagnetic wave front inside the planar waveguide, at least one back side reflecting structure located behind the phase array, and at least one deflecting structure, implemented in the dielectric layer, configured to deflect the electromagnetic wave front inside the planar waveguide, wherein a permittivity value of the at least one deflecting structure is not equal to a permittivity value of the dielectric layer of the planar waveguide.

20 Claims, 7 Drawing Sheets

(56) References Cited

U.S. PATENT DOCUMENTS

| | | | | |
|---|---|---|---|---|
| 5,394,163 | A * | 2/1995 | Bullen | H01Q 1/281 343/700 MS |
| 5,767,807 | A * | 6/1998 | Pritchett | H01Q 3/24 342/374 |
| 6,154,176 | A * | 11/2000 | Fathy | H01Q 1/38 343/700 MS |
| 6,496,155 | B1 | 12/2002 | Sievenpiper et al. | |
| 6,982,676 | B2 * | 1/2006 | Sievenpiper | H01Q 15/08 343/754 |
| 6,987,493 | B2 | 1/2006 | Chen | |
| 7,528,788 | B2 * | 5/2009 | Dunn | H05K 1/162 343/700 MS |
| 8,493,281 | B2 | 7/2013 | Lam et al. | |

* cited by examiner

PLANAR LINEAR PHASE ARRAY ANTENNA WITH ENHANCED BEAM SCANNING

CROSS-REFERENCE TO RELATED APPLICATION(S)

This application claims the benefit under 35 U.S.C. §119 (a) of a Russian patent application filed on Jul. 15, 2014 in the Russian Patent Office and assigned Serial number 2014129187, and of a Korean patent application filed on Jun. 25, 2015 in the Korean Intellectual Property Office and assigned Serial number 10-2015-0090368, the entire disclosure of each of which is hereby incorporated by reference.

TECHNICAL FIELD

The present disclosure relates to antenna technology. More particularly, the present disclosure relates to a planar linear phase array antenna with enhanced beam scanning.

BACKGROUND

In the technological field of scanning antennas, increasing a scan angle is a very practical issue in order to improve the efficiency of a system. The scan angle of an antenna array of the related art is usually restricted to ±45 degrees without a considerable gain loss. However, special facilities are required for realization of the scan angle enhanced up to 70 degrees, especially for mobile devices, because optimal traffic varies within wide limits.

A conformal antenna array (cylindrical), Luneburg lens antennas, switchable axisymmetric antennas are applied to increase the scan angle. These types of antennas allow acquisition of a scan angle of ±90 and more. However, there are some drawbacks inherent for these antenna types.

1. The presence of an intricate switch inserting an additional loss.
2. Large spatial sizes.
3. Small efficiency of an antenna's aperture in a case of switched antennas.

The antenna arrays of the related art are suitable for obtaining extended beam scanning by special structures installed in front of the arrays. These structures cause the additional front wave deflection. However, these structures are used usually for large arrays having wide sides.

Therefore, all of the afore-mentioned technologies are not suitable for designing very compact antenna devices.

There are some known solutions directed to creating a very compact phase antenna array that provides beam scanning over a possible wide range.

FIG. 7 illustrates an end-fire linear array antenna according to the related art.

Referring to FIG. 7, for example, U.S. Pat. No. 6,496,155 (End-fire antenna or array on surface with tunable impedance) discloses an antenna being an end-fire linear array. Elements of the array are located on the surface of a printed circuit board (PCB). Azimuth scanning is realized by phase relations between elements. A shortcoming with this array is a restricted scan angle (less than 40 degrees) due to lack of sufficiently wide beam of an elementary radiator.

FIG. 8 illustrates a planar one-dimension scanning lens antenna according to the related art.

Referring to FIG. 8, for example, a non-patent document "Beamforming Lens Antenna on a high resistivity silicon wafer for 60 GHz WPAN" (IEEE Transaction of Antennas and Propagation vol. 58, No 3, March 2010) discloses a planar one-dimension scanning lens antenna. The antenna is produced by PCB technology. Shortcomings with the antenna are a restricted scan angle (±40 degrees) and the need for a complicated switch for a beam steering operation.

FIG. 9 illustrates an antenna array including an active radiating element and one or more parasitic elements according to the related art.

Referring to FIG. 9, for example, U.S. Pat. No. 6,987,493 (Electrically steerable passive array antenna) discloses an antenna array including an active radiating element and one or more parasitic elements. Each parasitic antenna element is located on a circle around the radiating antenna element. The impedance of a passive element is changed by a tunable capacitor connected to each parasitic element. Due to an impedance variation, the phase of a reradiated wave is changed and as a result, the direction of a main beam is replaced. This antenna has a planar structure and provides circular one-plane scanning. Shortcomings with this antenna structure are a small front/back ratio, low directivity, one active channel only, and the need for active tunable elements and a DC controller.

FIG. 10 illustrates an antenna structure including two principal parts, a planar antenna array and a buckyball-shaped lens structure covering the antenna array according to the related art.

Referring to FIG. 10, for example, U.S. Pat. No. 8,493,281 (Lens for scanning angle enhancement of phased array antennas) considered as a prototype for the present disclosure discloses an antenna structure including two principal parts, a planar antenna array and a buckyball-shaped lens structure covering the antenna array. A design of the lens is created for a negative index metamaterial lens. The planar antenna array is employed for high directional beam forming and restricted beam scanning. The buckyball-shaped lens is capable of bending a beam generated by a phased array antenna at about 90 degrees. This solution also has shortcomings, the antenna array has very large spatial sizes. The spherical form of a declining lens does not allow application of this solution for integrating with portable devices, such as hand-held phones and tablet person computers (PCs).

Further, the previously known antennas that provide beam scanning have such drawbacks as high complexity in production and assembly, the presence of complicated switching and feeding circuits, and partial use of radiating elements.

Therefore, a need exists for a planar linear phase array antenna with enhanced beam scanning.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an extremely compact phase antenna array providing beam scanning at an angle equal to or greater than ±75 degrees.

In accordance with an aspect of the present disclosure, a planar phase array antenna is provided. The planar phase array antenna includes a planar waveguide formed by a top ground and a bottom ground with a dielectric layer between the top ground and the bottom ground, a phase array, including radiators, configured to form an electromagnetic wave front inside the planar waveguide, at least one back side reflecting structure located behind the phase array, and at least one deflecting structure, implemented in the dielectric layer, configured to deflect the electromagnetic wave front inside the planar waveguide, wherein a permittivity value of the at least one deflecting structure is not equal to a permittivity value of the dielectric layer of the planar waveguide.

According to some embodiments of the present disclosure, the top ground may be shorter than the bottom ground.

According to some embodiments of the present disclosure, the planar phase array antenna may further include a transformer configured to transform a vertical polarized wave to a horizontal polarized spatial wave formed along an outer boundary of the planar waveguide.

According to some embodiments of the present disclosure, a whole antenna may have a planar form and may be produced based on printed circuit board (PCB) technology but is not limited to. These features are very attractive for implementation of an antenna within compact devices for mobile scenario, such as hand-held phones, tablet person computers (PCs), and the like.

In comparison with analogues antenna of the related art, the antenna according to the embodiments of the present disclosure does not have any variable active lumped elements for beam scanning. A main feature of this antenna is application of a special deflecting structure represented by a metamaterial medium for obtaining enhanced beam scanning. The medium presents a special form area inside the PCB structure. This metamaterial area is formed so as to realize an additional delay of a wave front at the antenna array periphery. This phase delay causes additional deflection of the wave front. As a delaying metamaterial, a metalized holes (via) inside the PCB is used. Due to different heights of the holes (via) into a padding area, the irregular delaying of the wave front is obtained. As a result, the beam scanning of a single phase array is enhanced from ±55 degrees to ±75 degrees.

The main difference of the present disclosure from the prototype is the realization of a deflecting area inside a very thin planar structure, for example, the PCB structure. Therefore, the described device may be designed as an element of devices for a portable scenario (hand-held phones, tablet PCs, and the like). The deflecting system of the prototype represents a spherical, not compact, form.

According to an embodiment of the present disclosure, the antenna represents a linear phase array. However, other possible phase array structures could be used.

Any suitable types of radiators may be used as elements of the array. Monopoles are preferred because they provide best matching and possibility of PCB realization. Loop radiators may also be advantageously used.

The number of radiators may be different and it is restricted only by design requirements.

Elements of the array located into the medium of the solid dielectric layer (the PCB substrate) between a couple of horizontal parallel ground planes. The combination of ground planes and the solid dielectric form a planar waveguide. The common reflector is disposed back from a line of radiators at a distance approximately ¼ wave length into the solid dielectric for best matching and optimal beamforming. The array of radiators in combination with a reflector forms a unidirectional plane wave propagated inside the planar waveguide. The planar waveguide is formed by a couple of parallel ground planes and the dielectric substrate between the ground planes. The optimal form of the outer boundary of the planar waveguide is a semicircle, but any symmetrical curves are also possible (i.e., ellipse, parabolic, and the like), and radiated elements are situated along the diameter. It is possible to steer the wave front direction in a relatively normal position by phase control at the radiators (for example, vertical monopoles). The area of the deflecting structure is disposed between the radiation array and the outer boundary of the planar waveguide. The deflecting structure includes one or more sub-deflectors. The first sub-deflector is a major and located closely to the outer boundary of the planar waveguide. In addition, the second sub-deflector may be used which is auxiliary and located between the phase array and the first sub-deflector.

According to one of embodiments of the present disclosure, provided into the solid dielectric, the profile of the first sub-deflector area is shaped into a horseshoe convex to the periphery of the antenna. The thickness of the first sub-deflector area is minimal in the center and smoothly increases towards sides. The deflecting structure itself could represent an artificial dielectric with various permittivity values. First sub-deflector permittivity is more than the solid dielectric's one, and second sub-deflector permittivity is less than the solid dielectric's one. The artificial dielectric of the first sub-deflector causes complementary delay of the wave front and furthermore the delay is not constant for different parts of the wave front because the thickness of the first sub-deflector varies too. Accordingly, when the front of a wave is deflected, the side of the wave front located closely to the array will experience more delay due to the larger thickness of the artificial dielectric. As a result, the scanning angle is extended.

In order to increase the deflection efficiency, the second sub-deflector could represent the artificial dielectric having a permittivity less than a permittivity of the dielectric layer. This area is near the inner side of the first deflector and has a profile of a crescent. The thickness of the second sub-deflector area is maximal in the center and smoothly decreases towards the sides. The process of impact on the wave front is the inverse of the described above one. The part of the wave front, which is more distant from the radiators' array passes through a thicker region of the second area than the opposite one. Due to the lower permittivity of the second area, this part of the wave front gets additional acceleration and this effect causes the complementary deflection of the whole front. The area of the first sub-deflector is artificial dielectric including tens of metalized holes (via) into the dielectric layer of the planar waveguide (PCB dielectric media). Every metalized holes (via) is the discontinuity into the planar waveguide and distinguished by some impedance due to which the extra phase delay is obtained. At that value of permittivity and phase delay depend on the height of the holes (via). The distance between the holes (via) approximately equals a ¼ wave length into the substrate for realization of maximal transparency of the deflecting structure.

The area of the second sub-deflector is artificial dielectric with a lower permittivity than substrate's one including tens of metalized holes through unmetallized holes (via). Because the holes for this case are filled by air, the effective permittivity of this area may be less than one of a solid dielectric. The value of permittivity is determined by the density and diameter of holes. Passing through this medium the wave undergoes the complementary acceleration regarding to the solid dielectric. Thus, there is a double effect of the additional deflecting of the wave front here, specifically deceleration of one side of the wave front and acceleration of the other side of the wave front. If the bore side direction mode (without scanning) is generated, the sides of the wave front get the similar delay because of the symmetric form of the deflecting structure. However, the wave front is warped due to high speed of wave in the middle part of the antenna, this distortion may be compensated by corresponding phase correction at radiators. Further, the passed through deflecting structure transversal electromagnetic (TEM) wave proceeds to an edge of antenna and is irradiated into space.

Due to the extremely small height of the planar waveguide restricted by the thickness of the PCB, the efficiency of radiation is very low. In such a case, according to an embodiment of the present disclosure, it is proposed to use transformation of the vertical polarization to horizontal one that allows realization of the high radiation efficiency. The vertical polarized wave that has reached the edge of the planar waveguide is distributed to a group of channels through exponent tapers allocated at the edge of the planar waveguide. These tapers represent the extension of the planar waveguide. Every partial wave passed through the exponential taper come in the dipole oriented horizontally. Every arm of the dipole is the continuance of top or bottom ground of the planar waveguide. The effective length of dipoles is sufficient (about ½ wave length). Therefore, the space matching and radiation are very good. In a view of the total directivity increase, the director disposed in front of every dipole.

According to another aspect of the present disclosure, the architecture of the antenna may be simplified in a case of increasing the thickness of the planar waveguide, thereby obviating the need for polarization transforming.

According to another aspect of the present disclosure, the antenna is ended by a smooth edge of the planar waveguide and polarization of radiation is vertical. The top ground is shorter than the bottom ground. The protruding part of the dielectric layer in combination with the bottom ground serves as a matching transformer between the planar wave guide and space.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Figure 1A:
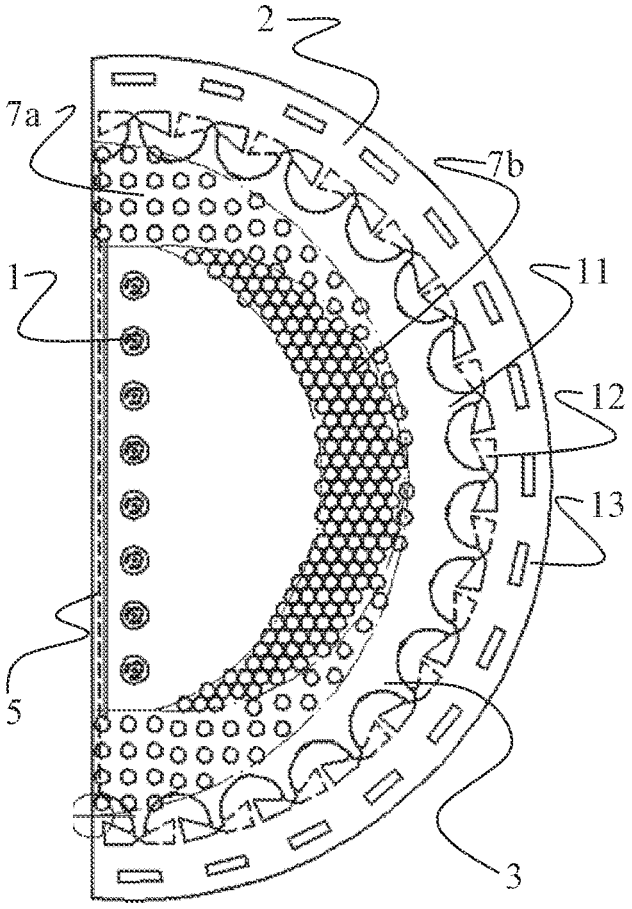
FIGS. 1A, 1B, and 1C illustrate a planar linear phase array antenna with an enhanced beam scanning angle according to an embodiment of the present disclosure.
Figure 1B:
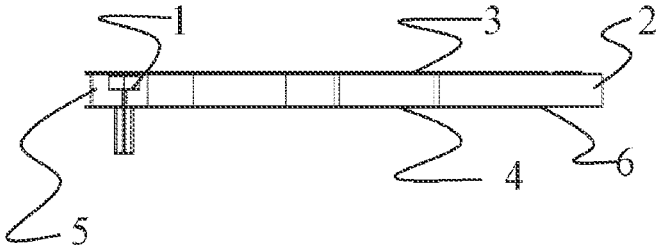
Figure 1C:
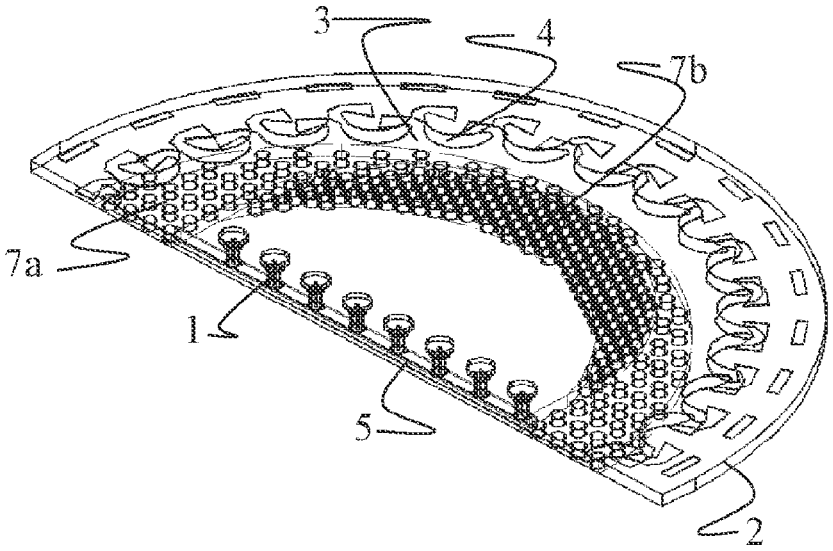

FIGS. 1A, 1B, and 1C illustrate a planar linear phase array antenna with an enhanced beam scanning angle according to an embodiment of the present disclosure.

Specifically, FIG. 1A is a plane view of the planar linear phase array antenna with an enhanced scanning angle, FIG. 1B is a side view of the planar linear phase array antenna with an enhanced scanning angle, and FIG. 1C is a perspective view of the planar linear phase array antenna with an enhanced scanning angle.

Referring to FIGS. 1A, 1B, and 1C, a radiating array is presented as a line of vertical monopoles 1 arranged into a dielectric layer 2 between a top ground 3 and a bottom ground 4. The subject matter of the present disclosure doesn't limit the number of monopoles. The number of radiators (monopoles) is appropriately selected according to design requirements. The top ground 3 and the bottom ground 4 are configured into metal layers, such as copper foils. The dielectric layer 2, the top ground 3, and the bottom ground 4 collectively form a planar waveguide. The radius of an upper part of every monopole 1 is larger than the radius of a lower part of the monopole 1, for better matching with a low impedance of the planar waveguide.

The array irradiates a vertical polarized transversal electromagnetic (TEM) wave into the space of the planar waveguide. To provide one-directional propagation, a back side common reflector 5 is located behind the monopoles 1 at a distance of an approximately ¼ wavelength inside the dielectric layer 2. When an exciting phase is same for every monopole 1, the wave front is propagated normally to the array. The direction of propagation takes some deflection provoked by a phase difference between the monopoles 1. In the process of propagation of the wave front from the monopoles 1 to a planar waveguide edge 6, the planar wave passes through an area of a deflecting structure including a first sub-deflector 7*a* and a second sub-deflector 7*b*. The planar form of the deflecting structure is partially cylindrical, and the generator of cylinder is perpendicular to the top ground 3 and the bottom ground 4.

Figure 2A:
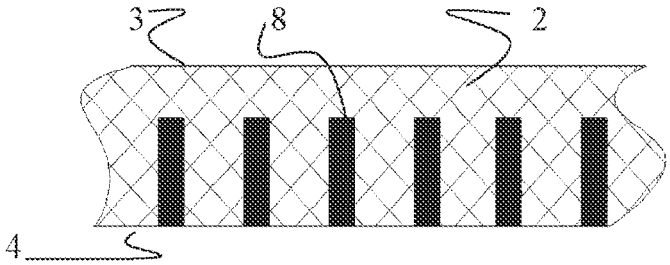
FIGS. 2A and 2B illustrate a pattern of deflection components according to an embodiment of the present disclosure.
Figure 2B:
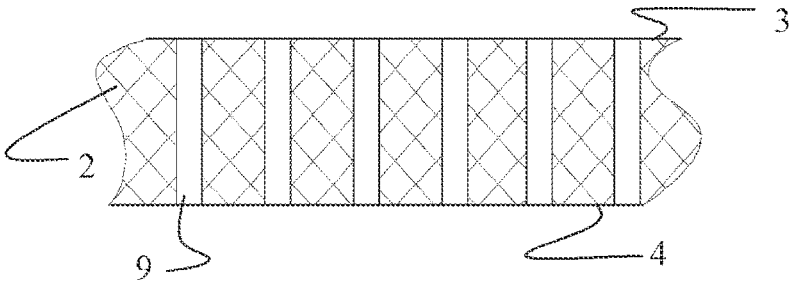

FIGS. 2A and 2B illustrate a pattern of deflection components according to an embodiment of the present disclosure.

Referring to FIGS. 2A and 2B, a pattern of components of the top sub-deflector 7*a* and the bottom sub-deflector 7*b* is illustrated. The cylinder's base of the first sub-deflector 7*a* is shaped into a horseshoe with a thickness increased from a normal direction (that is, a central point) toward the sides. The area of the first sub-deflector 7*a* is filled with the holes (via) 8. The holes 8 are, for example, non-through holes. The metalized holes 8 are spaced an approximately ¼ wavelength from each other, for maximal transparency of the deflector. Tens of metalized holes 8 have an artificial dielectric property due to a complementary phase delay of a propagated wave. This delay is provoked by some reactance of the metalized holes (via) because of certain discontinuity inside the planar waveguide. The permittivity of this artificial dielectric is greater than that of the dielectric layer 2.

To purposely enhance the effect of additional deflection, the second sub-deflector 7*b* is implemented. The sub-deflector 7*b* is interposed between the first sub-deflector 7*a* and the monopoles 1. Herein, compared to the first sub-deflector 7*b*, the area of the second sub-deflector 7*b* is filled with non-metallic hollow holes 9. The permittivity of the dielectric layer 2 is lower than one of a solid dielectric. The area of the second sub-deflector 7*b* is near the first sub-deflector 7*a*, and the profile of this area is the reverse of that of the first sub-deflector 7*a*. Specifically, the thickness of the planar shape of the area of the second sub-deflector 7*b* is maximal in a normal direction with respect to the line of the radiators and is smoothly reduced toward the sides. The structure of the second sub-deflector 7*b* may be regarded actually as an area having a plurality of holes formed into the dielectric layer that forms the planar waveguide.

Figure 3:
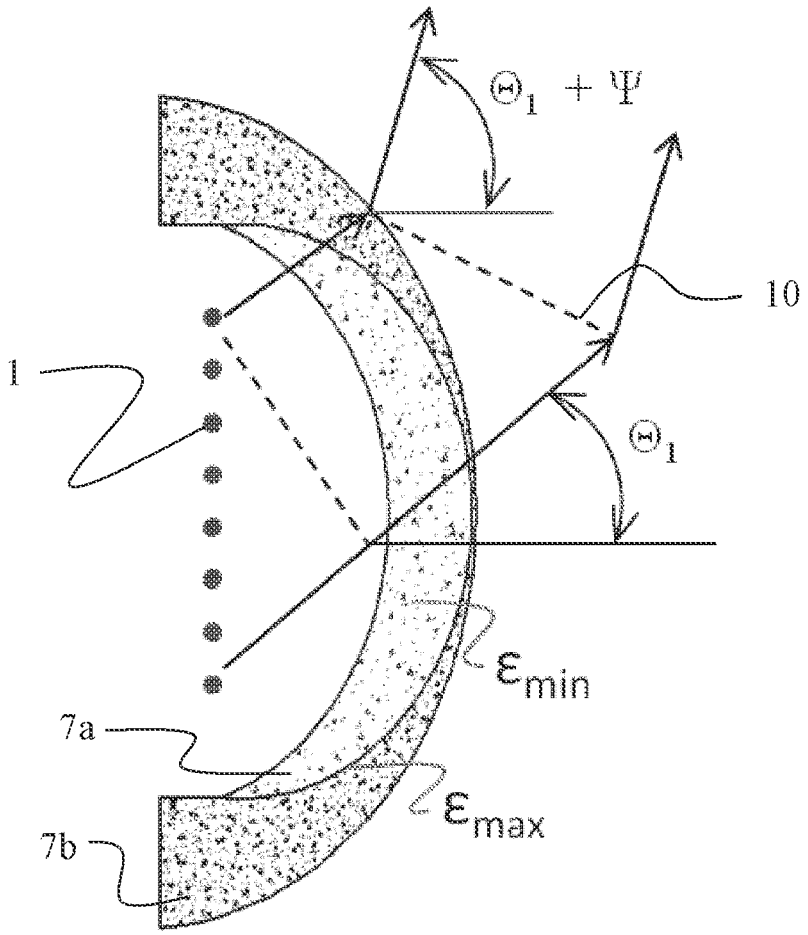
FIG. 3 illustrates a beam deflection process according to an embodiment of the present disclosure.

FIG. 3 illustrates a beam deflection process according to an embodiment of the present disclosure.

Referring to FIG. 3, a process of wave front propagation is illustrated. When a wave front 10 is deflected by an angle $\Theta_1$ due to a phase shift between signals exciting the monopoles 1, one side of the wave front disposed close to the array may be delayed more than the opposite side of the wave front due to different lengths of the propagation paths inside the delaying first sub-deflector 7*a*. On the contrary, the other side of the wave front is accelerated due to a longer path inside the second sub-deflector 7*b* with a less permittivity of an artificial dielectric. Thus, there is a double effect of deflection of the wave front 10, that is, deceleration of one side of the wave front 10 and acceleration of the other side of the wave front 10. Thus, an initial scan angle acquires a complementary value $\Psi$. Therefore, for instance, the scan angle ±60 degrees is extended to ±75 to 80 degrees. In a case of normal propagation (without beam deflection), both sides of the wave front have the same delay because the paths are symmetrical and there is no complementary deflection.

After the deflection structure, the scattered TEM wave reaches the planar waveguide edge 6. However the radiation of a vertical polarized wave is insignificant because of an extremely small height (thickness) of the planar waveguide. The maximal height of the planar waveguide is restricted by the thickness of the printed circuit board (PCB). Sufficient matching with space may be realized by transformation of vertical polarization to horizontal polarization.

Figure 4:
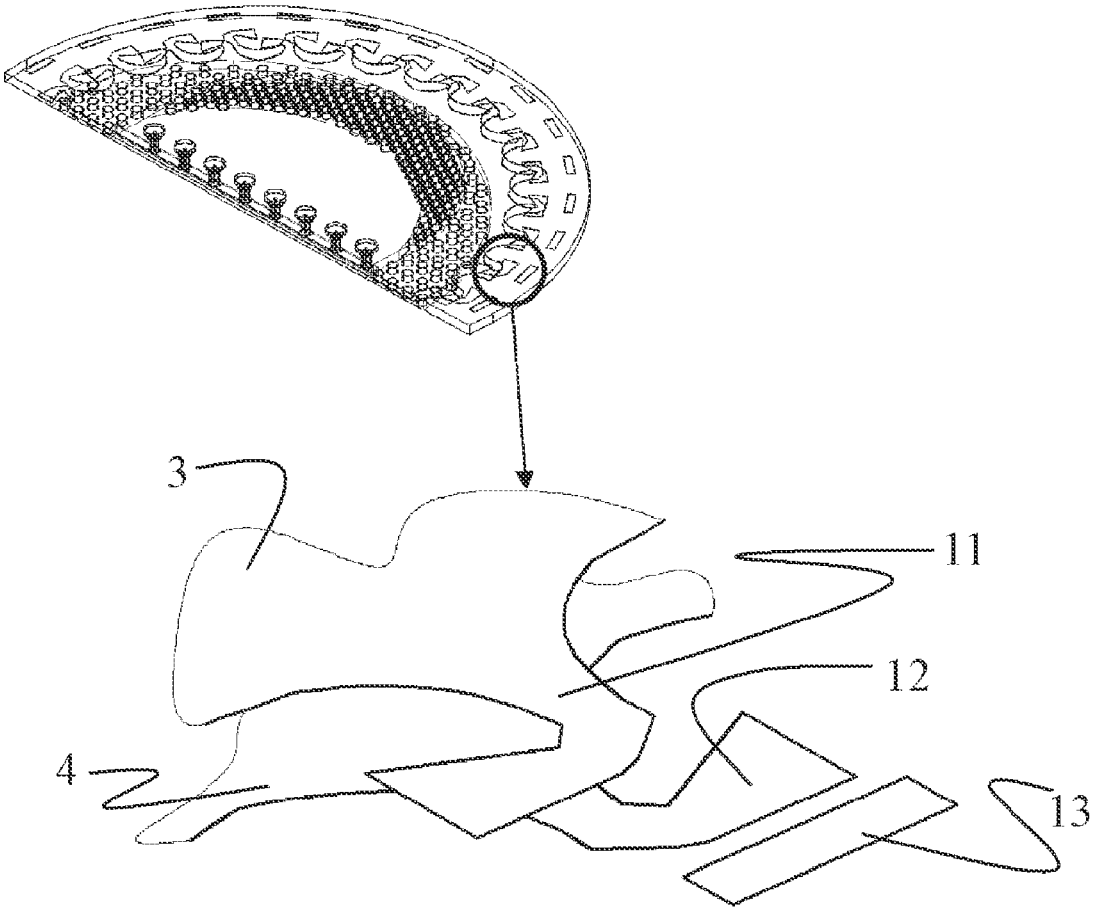
FIG. 4 illustrates an edge of a planar waveguide terminated by a dipole according to an embodiment of the present disclosure.

FIG. 4 illustrates an edge of a planar waveguide terminated by a dipole according to an embodiment of the present disclosure.

Referring to FIG. 4, a procedure of polarization transformation is illustrated. A wave at the edge of the planar waveguide is split and distributed through exponential tapers 11. The exponential tapers 11 are extensions of the planar waveguide. Further, the scattered partial waves are radiated through dozens of horizontal dipoles 12. The length of the horizontal oriented dipoles is sufficient for efficient matching of the whole antenna with space. From the viewpoint of directivity improvement, an additional director 13 is installed at the radiation-direction front of every dipole 12.

The exponential tapers 11 may be formed in a metal pattern extended to a metal layer respectively on the top ground 3 and the bottom ground 4. Each of the horizontal dipoles 12 may be formed into a combination of two arms. One of the two arms may be formed into a metal pattern connected to a taper formed on the top group and the other arm may be formed into a metal pattern connected to a taper formed on the bottom ground 4. Further, the director 13 may be formed into an appropriate metal pattern (for example, a square bar type) at the front of a dipole arm formed on the bottom ground 4.

Figure 5:
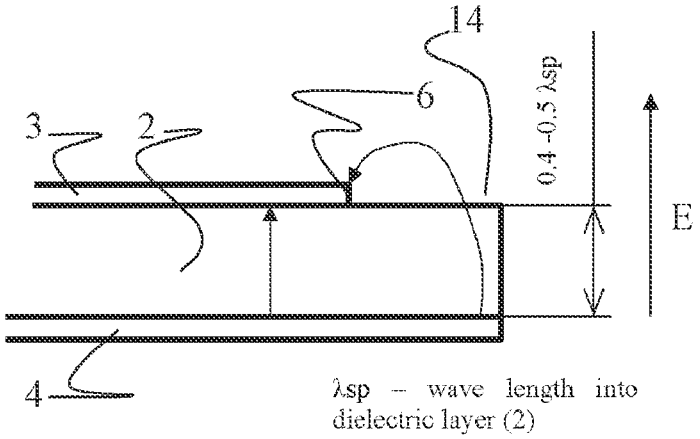
FIG. 5 illustrates an antenna that realizes vertical polarized radiation according to an embodiment of the present disclosure.

FIG. 5 illustrates an antenna that realizes vertical polarized radiation according to an embodiment of the present disclosure.

Figure 6A:
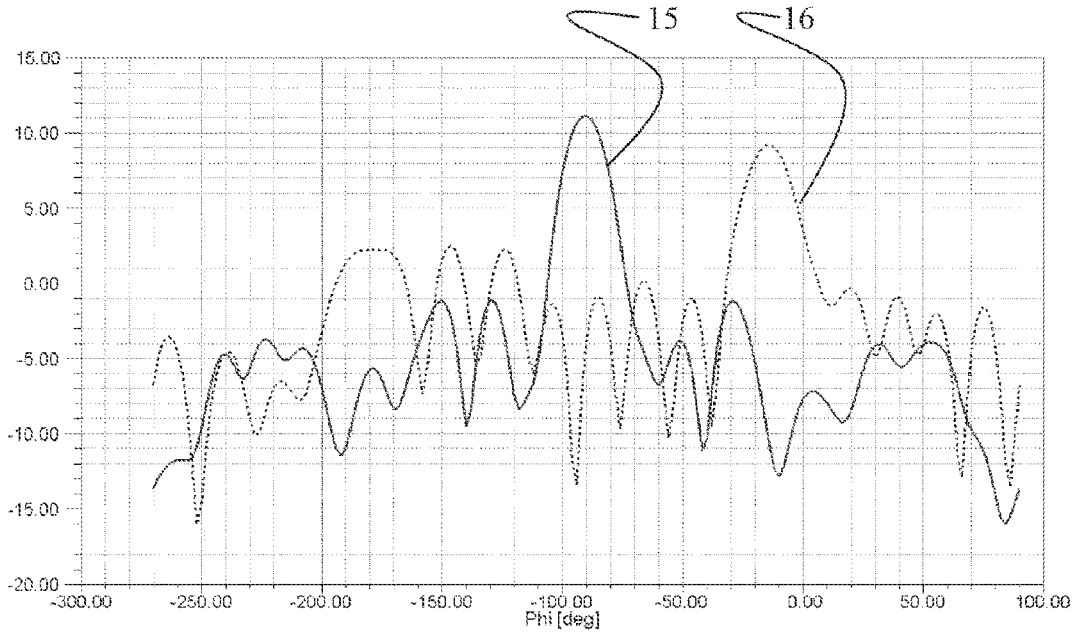
FIGS. 6A and 6B are charts illustrating radiation patterns for both an E-plane and an H-plane according to an embodiment of the present disclosure.
Figure 6B:
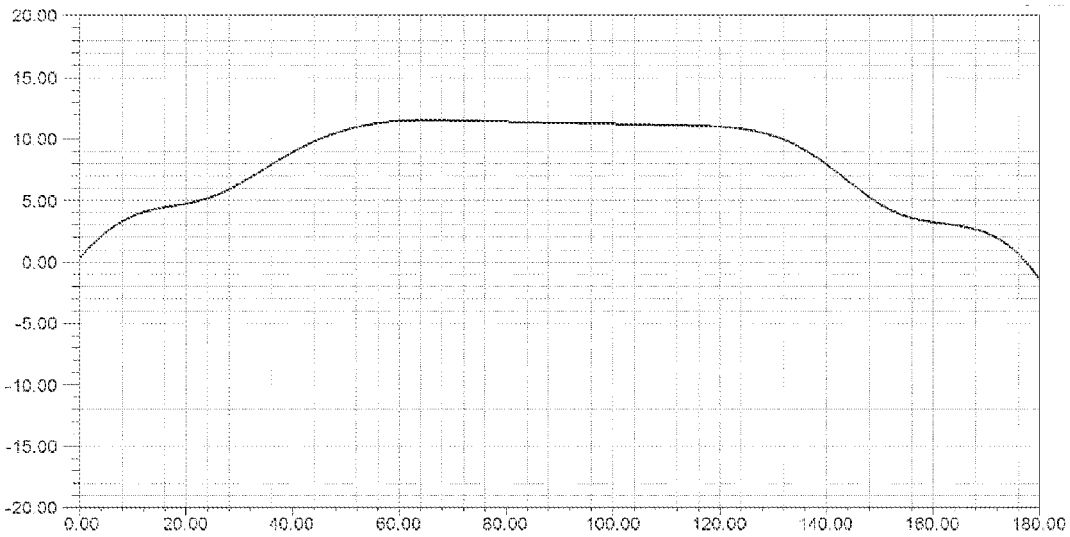
Figure 7:
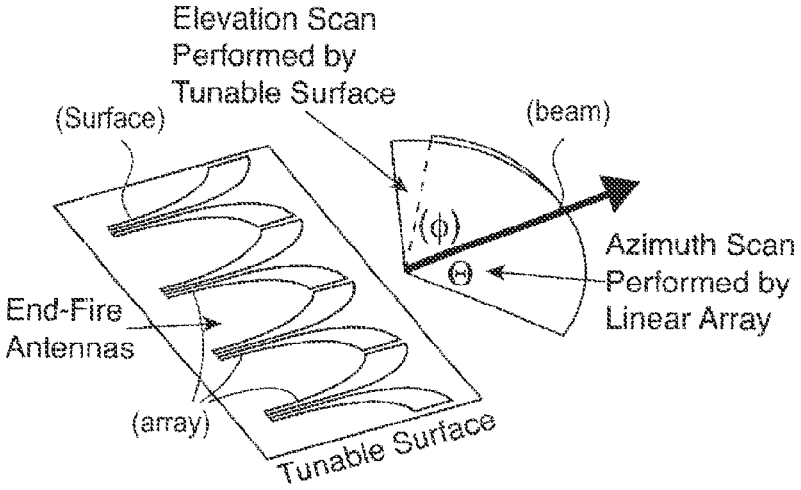
FIG.7 (RELATED ART)
FIG. 7 illustrates an end-fire linear array antenna according to the related art.
Figure 8:
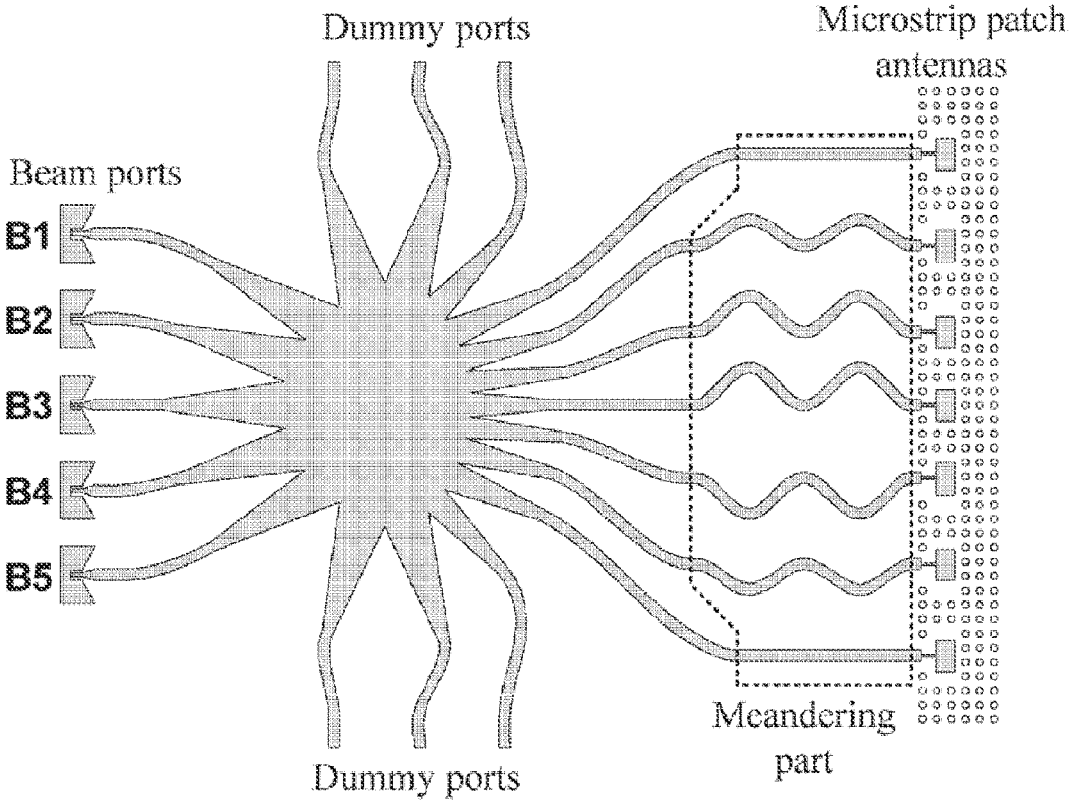
FIG.8 (RELATED ART)
FIG. 8 illustrates a planar one-dimension scanning lens antenna according to the related art.
Figure 9:
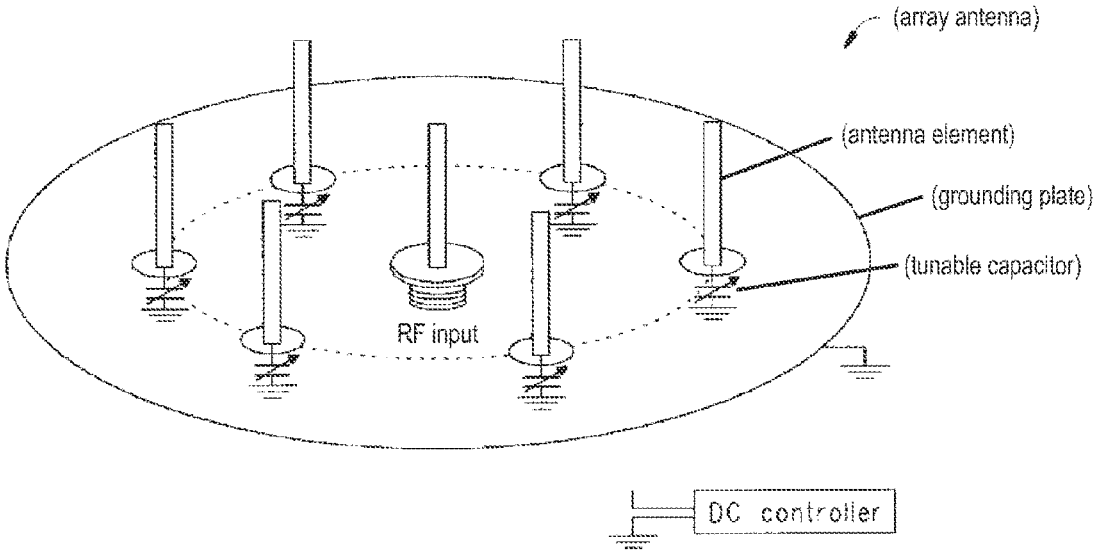
FIG.9 (RELATED ART)
FIG. 9 illustrates an antenna array including an active radiating element and one or more parasitic elements according to the related art.
Figure 10:
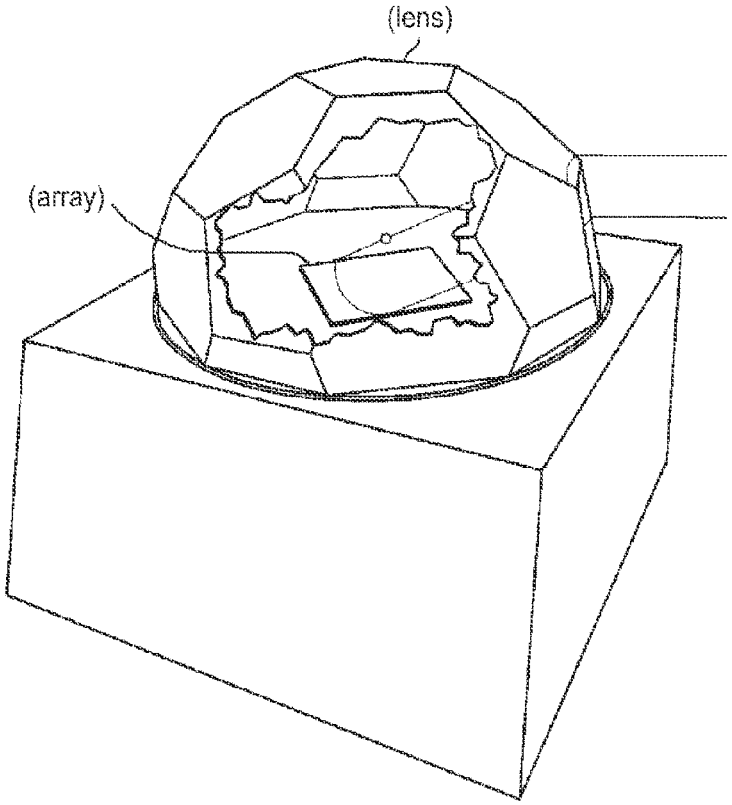
FIG.10 (RELATED ART)
FIG. 10 illustrates an antenna structure including two principal parts, a planar antenna array and a buckyball-shaped lens structure covering the antenna array according to the related art.

FIGS. 6A and 6B are charts illustrating radiation patterns for both an E-plane and an H-plane according to an embodiment of the present disclosure. In FIG. 6A, examples of a non-deflecting main beam 15 and a maximal deflecting main beam 16 are illustrated.

Referring to FIGS. 5, 6A, and 6B, the structure of the antenna may be simplified. Therefore, if it is possible in a particular application to take a thicker dielectric layer 2, the need for the polarization transformation may be obviated, because matching of the high planar waveguide with space is great. In this case, the antenna is ended at the smooth edge of the planar waveguide and polarization of radiation is vertical. The top ground 3 is shorter than the bottom ground 4. A protruding part 14 of the dielectric layer 2 in combination with the bottom ground 4 serves as a matching transformer between the planar waveguide and space. However, to realize this antenna version, there should be a strong restriction on the thickness of the dielectric layer 2. Specifically, the height (thickness) of the antenna has to be equal to or larger than about 0.4 to $0.5\lambda_{sp}$, where $\lambda_{sp}$ is a wave length into the dielectric layer 2.

Meanwhile, the height (thickness) of the dielectric layer in the antenna having a polarization transformation structure as in some embodiments of the present disclosure may be about $0.08\lambda_0$ or larger, where $\lambda_0$ is a wave length into space.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A planar phase array antenna comprising:

a planar waveguide formed by a top ground and a bottom ground with a dielectric layer between the top ground and the bottom ground;

a phase array including radiators configured to form an electromagnetic wave front inside the planar waveguide;

at least one back side reflecting structure located behind the phase array; and at least one deflecting structure, implemented in the dielectric layer, configured to deflect the electromagnetic wave front inside the planar waveguide, wherein a permittivity value of the at least one deflecting structure is not equal to a permittivity value of the dielectric layer of the planar waveguide.

2. The planar phase array antenna of claim 1, wherein the at least one deflecting structure has a permittivity greater than a permittivity of the dielectric layer of the planar waveguide, and wherein a planar area of the at least one deflecting structure is minimal in a central normal line to a line of the radiators and maximal at both sides.

3. The planar phase array antenna of claim 1, wherein the at least one deflecting structure comprises a first sub-deflector and a second sub-deflector, which are adjacent to each other, wherein the second sub-deflector is disposed between the phase array and the first sub-deflector, wherein a permittivity of the first sub-deflector is greater than a permittivity of the dielectric layer of the planar waveguide, wherein a planar area of the first sub-deflector is minimal in a normal line to a line of the radiators and maximal at both sides, wherein a permittivity of the second sub-deflector is less than a permittivity of the dielectric layer of the planar waveguide, and wherein the planar area of the thickness of the second sub-deflector is maximal in a normal line to the line of the radiators and minimal at both sides.

4. The planar phase array antenna of claim 1, wherein the phase array comprises a linear phase array.

5. The planar phase array antenna of claim 1, wherein the radiators comprise vertical monopoles or loop radiators.

6. The planar phase array antenna of claim 1, wherein the phase array antenna is implemented in a printed circuit board (PCB) dielectric substrate.

7. The planar phase array antenna of claim 3, wherein the area of the first sub-deflector comprises an artificial dielectric filled with metalized holes.

8. The planar phase array antenna of claim 7, wherein the metalized holes are spaced approximately ¼ wave length from each other.

9. The planar phase array antenna of claim 3, wherein the first sub-deflector is shaped into a horseshoe.

10. The planar phase array antenna of claim 3, wherein the second sub-deflector comprises a perforated dielectric layer.

11. The planar phase array antenna of claim 3, wherein the second sub-deflector is disposed near an inner side of the first sub-deflector and has a profile of a crescent.

12. The planar phase array antenna of claim 1, wherein the planar waveguide comprises a semicircle outer boundary.

13. The planar phase array antenna of claim 1, wherein the shape of the outer boundary of the planar waveguide comprises a symmetrical curve chosen from at least one of ellipse or parabolic.

14. The planar phase array antenna of claim 13, wherein the radiating elements are disposed along a diameter of the planar waveguide.

15. The planar phase array antenna of claim 1, wherein the top ground is shorter than the bottom ground.

16. The planar phase array antenna of claim 1, further comprising a transformer configured to transform a vertical polarized wave to a horizontal polarized spatial wave formed along an outer boundary of the planar waveguide.

17. The planar phase array antenna of claim 16, wherein the transformer is further configured to transform a vertical polarized wave to a horizontal polarized spatial wave including horizontal oriented dipoles in combination with exponential tapers.

18. The planar phase array antenna of claim 16, wherein the exponential tapers are provided as an extension of the planar waveguide and split and distributed waves at an edge of the planar waveguide.

19. The planar phase array antenna of claim 18, wherein the horizontal oriented dipoles radiate the split and distributed waves.

20. The planar phase array antenna of claim 17, wherein a director is formed to induce a direction of a radiation beam at a radiation-direction front of the horizontal oriented dipoles.

* * * * *